US008526160B2

(12) United States Patent
Kotos

(10) Patent No.: US 8,526,160 B2
(45) Date of Patent: Sep. 3, 2013

(54) ELECTRICALLY INSULATED COVERINGS FOR ELECTRIC STUN DEVICE DARTS

(76) Inventor: John Louis Kotos, Blue Island, IL (US)

( * ) Notice: Subject to any disclaimer, the term of this patent is extended or adjusted under 35 U.S.C. 154(b) by 0 days.

(21) Appl. No.: 13/541,224

(22) Filed: Jul. 3, 2012

(65) Prior Publication Data

US 2013/0021716 A1 Jan. 24, 2013

Related U.S. Application Data

(60) Provisional application No. 61/572,562, filed on Jul. 18, 2011.

(51) Int. Cl.
*F41B 15/04* (2006.01)

(52) U.S. Cl.
USPC ..... 361/232

(58) Field of Classification Search
USPC ..... 361/232
See application file for complete search history.

(56) References Cited

U.S. PATENT DOCUMENTS

| | | | | |
|---|---|---|---|---|
| 3,523,538 | A * | 8/1970 | Shimizu | 607/58 |
| 3,803,463 | A * | 4/1974 | Cover | 361/232 |
| 4,253,538 | A * | 3/1981 | Weber et al. | 181/119 |
| 5,654,867 | A * | 8/1997 | Murray | 361/232 |
| 5,831,199 | A * | 11/1998 | McNulty et al. | 89/1.11 |
| 6,131,193 | A * | 10/2000 | Bachner, Jr. | 2/2.5 |
| 6,575,073 | B2 * | 6/2003 | McNulty et al. | 89/1.11 |
| 6,636,412 | B2 * | 10/2003 | Smith | 361/232 |
| 2005/0039328 | A1 * | 2/2005 | Irby et al. | 29/802 |
| 2007/0063848 | A1 * | 3/2007 | Weisman | 340/573.1 |
| 2007/0167241 | A1 * | 7/2007 | Stethem et al. | 463/47.3 |
| 2012/0255429 | A1 * | 10/2012 | Kotos | 89/36.02 |
| 2013/0021716 | A1 * | 1/2013 | Kotos | 361/232 |

* cited by examiner

*Primary Examiner* — Ronald W Leja

(57) ABSTRACT

An electrically insulated covering applied to specific parts of electric stun device darts that will negate the protective properties of electrically conductive garments designed to nullify the debilitating effects of electric stun devices and rendering such devices inoperable thus protecting the electric circuitry of the and permitting proper operation of the electric stun device.

14 Claims, 2 Drawing Sheets

ELECTRICALLY INSULATED COVERINGS FOR ELECTRIC STUN DEVICE DARTS

CROSS-REFERENCE TO RELATED APPLICATIONS

U.S. Provisional Application for Patent No. 61/572,562, filed Jul. 18, 2011 entitled "ELECTRICALLY INSULATED COVERINGS FOR ELECTRIC STUN DEVICE DARTS" which is hereby incorporated by reference. Applicant claims priority pursuant to 35 U.S.C. 119 (e).

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention relates to electric stun devices and, more particularly, to electrically insulated coverings for darts that are expelled from the electric stun device by compressed air. Electrically insulating material is applied to areas of the darts that do not penetrate the living tissue of the target.

Electric stun devices have evolved with several methods for the delivery of a high voltage discharge to an intended target. Some of these methods include direct contact probes on the enclosure of the hand-held power supply for a direct contact method. Another method employs an auxiliary source propelled projectile with all elements of the power supply contained within the projectile. Yet another method utilizes electrically conductive liquids forcibly expelled from the hand-held power supply to deliver an immobilizing electric charge to a target. The most current and commercially available delivery system is that of dual compressed air propelled darts that serve as the high voltage electrode/projectiles with attached wires between the darts and the hand-held power supply. The leading end of each dart is fitted with a barb to penetrate the surface of, and secure itself to a target which in most cases is living tissue of a human being. This two tethered dart method is the system incorporated in the TAZER® device. The darts of the electric stun devices currently available are not insulated. The following U.S. Patents which disclose electric stun devices that employ the two tethered dart method of electric charge delivery or a reasonably similar method are cited. U.S. Pat. No. 3,523,538 entitled "ARREST DEVICE" issued on Aug. 11, 1970 to Kunio Shimizu discloses a delivery system that incorporates a single compressed air propelled projectile with two embedded electrodes and attached wires to the hand-held power supply. U.S. Pat. No. 3,803,463 entitled "WEAPON FOR IMMOBILIZATION AND CAPTURE" issued on Apr. 9, 1974 to John H Cover and U.S. Pat. No. 4,253,538 entitled "POWER SUPPLY FOR WEAPON FOR IMMOBILIZATION AND CAPTURE" issued on Feb. 24, 1981 to John H. Cover each disclose delivery systems using one or two tethered darts or a net tethered with a sufficient number of wires to the hand-held power supply. U.S. Pat. No. 5,654,867 entitled "IMMOBILIZATION WEAPON" issued on Aug. 5, 1997 to John H. Murray discloses a dual delivery system with the choice of the direct contact method or the two tethered dart method. U.S. Pat. No. 5,831,199 entitled "WEAPON FOR IMMOBILIZATION AND CAPTURE" issued on Nov. 3, 1998 to James McNulty Jr. et al discloses a delivery system that employs a modified two tethered dart method. U.S. Pat. No. 6,575,073 entitled "METHOD AND APPARATUS FOR IMPLEMENTING A TWO PROJECTILE ELECTRICAL DISCHARGE WEAPON" issued Jun. 10, 2003 to James McNulty Jr. et al discloses the use of a modified two tethered dart delivery system. U.S. Pat. No. 6,636,412 B2 entitled "HAND-HELD STUN GUN FOR INCAPACITATING A HUMAN TARGET" issued on Oct. 21, 2003 to Patrick W. Smith discloses a delivery system that employs the two tethered dart method.

All of the electric stun devices disclosed in the aforementioned patents incorporate some form of electric and/or electronic circuitry which, if short-circuited, will disable the device by reducing the high voltage charge to a low or zero voltage. If these electric stun devices are operated with a short-circuit condition for a prolonged period of time, it is most likely that the electrical and/or electronic circuitry would be damaged and render the device useless until it is completely disassembled and repaired. Various puncture resistant garments, which are electrically conductive, are generally rigid shields worn external of clothing and are constructed of bulky inflexible metals such as titanium or other extremely hard metal alloys. A more detailed analysis of these metallic vests and garments can be found in U.S. Pat. No. 6,131,193 entitled "COMBINED PUNCTURE RESISTANT AND BALLISTIC RESISTANT PROTECTIVE GARMENT" issued Oct. 17, 2000 to Thomas E. Bachner Jr. The disadvantages of the garments described in the "Background of the Invention" of U.S. Pat. No. 6,131,193 are due to the bulk and rigidity of such externally worn metallic vests. The primary disadvantages are that they are uncomfortable to wear, decrease mobility, cause fatigue and are not readily concealable. Garments made from metal coated fabrics as cited in U.S. Provisional Patent Application No. 61/465,553 entitled "ELECTRICALLY CONDUCTIVE APRON AND ACCESSORY TO PROTECT AGAINST ELECTRIC STUN DEVICE MISUSE" filed Mar. 21, 2011 by John L. Kotos and U.S. Provisional Patent Application No. 61/516,683 entitled "ELECTRICALLY CONDUCTIVE PROTECTIVE GARMENT ENSEMBLE TO PROTECT AGAINST ELECTRIC STUN DEVICE MISUSE" filed Apr. 6, 2011 by John L. Kotos render the effectiveness of currently available electric stun devices using the two tethered dart method negligible. Thus, there is a need for an electrically insulated covering for electric stun device darts, so that when the barbed ends are embedded in the living tissue of a human or another living target while wearing a garment made from a metal coated fabric, the protective properties of the garment are nullified and the normal operation of the electric stun device is unaffected.

BRIEF SUMMARY OF THE INVENTION

The primary object of the present invention is to provide electrically insulated darts for electric stun devices that cannot be accidentally or intentionally "shorted out" to the other dart that would render the intended effects of the electric stun device negligible. The present invention is specifically designed to counteract the protective properties of protective garment made from metal coated fabrics. It is another object of the present invention to provide electrically insulated darts for electric stun devices that cannot be accidentally or intentionally "shorted-out" to the other dart that could damage the electrical and/or electronic circuitry of the electric stun device. It is yet another object of the present invention that by preventing damage to the electrical/electronic circuitry of the electric stun device, the user of the electric stun device is protected from possible adverse effects of such damage. Such adverse effects can occur when the electric/electronic circuitry becomes damaged, the insulation breaks down within the hand-held power supply and the high voltage stun charge can arc onto the surface of the hand-held power supply. Another adverse effect of electric/electronic circuit damage comes in the form of over heated component starting on fire or exploding. Other objects, features and advantages of the present invention in its details and of fabrication and arrangement of materials will be seen from the following detailed description of the preferred embodiment of the present invention when considered with the drawings and from the appended claims.

DETAILED DESCRIPTION OF THE INVENTION

Figure 1A:
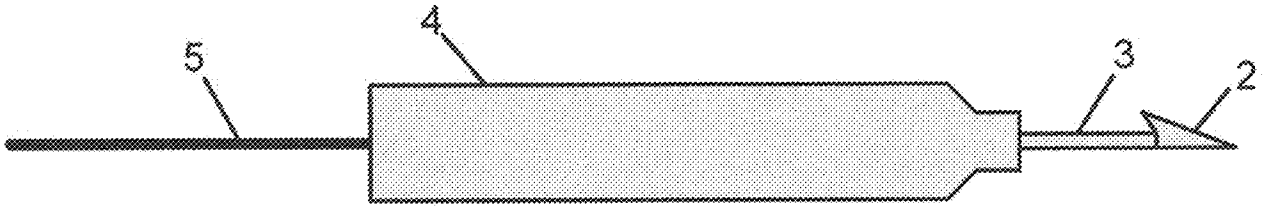
FIG. 1A is a cross-sectional view representative of a typical dart used in currently available electric stun devices.

The present invention has the primary objective of providing electrically insulated darts for electric stun devices that cannot be "shorted out" to each other because of protective garments manufactured using conductive metal bearing materials, such as metal coated fabrics. Electrically insulating most of the electric stun device darts, with the exception of a barbed end of each of the electric stun device darts that is embedded in the living tissue of a human target, would nullify the protective properties of the electrically conductive protective garment and permit proper operation of the electric stun device.

Referring now to the drawings in general, the illustrations are for the purpose of describing the present invention and are not intended to limit the invention thereto. All drawings are of an approximate proportion and approximate scale.

Figure 1B:
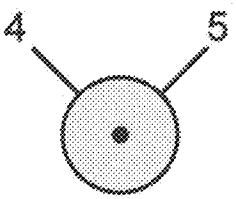
FIG. 1B is a rear view representative of a typical dart used in currently available electric stun devices.

FIG. 1A is a cross-sectional view representative of a dart (1) typically used in currently available electric stun devices. A dart (1) is comprised of a barb (2), a shaft (3) and a body (4). The barb (2) and the shaft (3) are one piece which is attached to the body (4). A tether (5), which is a thin electrically insulated wire, is shown attached to the body (4). The entire assembly of the barb (2), the shaft (3) and the body (4) are made of a conductive metal and are void of any electrical insulation. It is noted that the barb (2), the shaft (3) and the body (4) are shaded in FIG. 1A and FIG. 1B for clarity. Electric stun devices are normally used on humans wearing clothes. Upon contact with a human target, the barb (2) of the dart (1) penetrates the clothing and living tissue. The barb (2) is completely embedded in the living tissue with a portion of the shaft (3) entering the opening in the living tissue made by the barb (2). Therefore, the barb (2) and a portion of the shaft (3) are not in contact with the clothing. The body (4) remains outside the any of openings made by the barb (2). The barb (2) secures the dart (1) to the human target. If the clothing penetrated by the dart (1) is electrically non-conductive, the electric stun device functions normally and the target is stunned. If the clothing is electrically conductive, the electric stun device would be shorted out and rendered useless. FIG. 1B is a rear view representative of a typical electric stun device dart (1) used in currently available electric stun devices to be compared with FIG. 2B of the present invention.

Figure 2A:
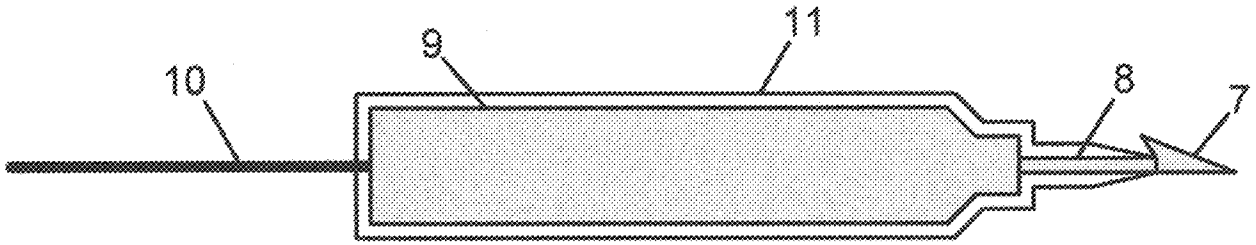
FIG. 2A is a cross-sectional view of the present invention as an electrically insulated covering on an electric stun device dart.
Figure 2B:
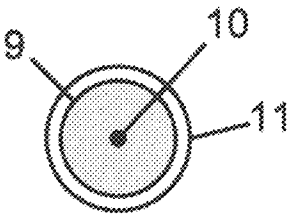
FIG. 2B is a rear view of the present invention as an electrically insulated covering on an electric stun device dart.

FIG. 2A, in accordance to the present invention, is a cross-sectional view of an electrically insulated covering (11) applied to an electrically insulated dart (6). The electrically insulated dart (6), in addition to the electrically insulated covering (11), is also comprised the same parts that comprise the dart (1) being that of a barb (7), a shaft (8), a body (9) and a tether (10). It is also noted that the barb (7), the shaft (8) and the body (9) are shaded in FIG. 2A and FIG. 2B for clarity. The electrically insulated covering (11) covers the entire body (9). The shaft (8) is insulated up to a point at or just before the barb (7). The electrically insulated covering (11) is comprised of an electrically insulating material. As previously stated, electric stun devices are normally used on humans wearing clothes. Upon contact with a human target, the barb (7) of the electrically insulated dart (6) penetrates the clothing and the living tissue. The barb (7) is completely embedded in the living tissue with a portion of the shaft (8) entering the opening in the living tissue made by the barb (7) and in full electrical contact with the human target. Any part of the present invention outside of the living tissue is insulated and in contact with the clothing. The operation of the electric stun device would not be compromised and a stun voltage would be delivered to the human target. FIG. 2B is a rear view of the present invention, the electrically insulated covering (11), applied to the electrically insulated dart (6) used in currently available electric stun devices. Most available electric stun devices utilize a disposable one-time use cartridge that houses the two darts (1) and the respective tethers (5) under pressure from compressed air propellant. A new model of electric stun device accepts three disposable one-time use cartridges. The present invention is applicable to both types of electric stun devices.

Referring to FIG. 2A, the breakdown voltage of the electrically insulated covering (11) depends mainly on its thickness, but also on the diameter of the body (9) and the shaft (8) and the type of insulating material. Insulating materials are rated by NEMA in volts per mil (thousandth of an inch). A typical diameter of the body (9) is two hundred fifteen thousandths of an inch, slightly larger that number four AWG wire. A typical diameter of the shaft (8) is thirty thousandths of an inch, slightly larger than number twenty one AWG wire. These factors indicate that the breakdown voltage for insulating material suitable for use in the present invention ranges from approximately six thousand volts per mil to ten thousand volts per mil. Although the these values are relatively small compared to the fifty thousand volts generated by an electric stun device, the breakdown voltage of the electrically insulating material used for the electrically insulated covering (11) is this minimal because of the one-time use of each dart cartridge, the relatively short duration of the term of use of the electrically insulated darts (6), the pulsed mode of operation of the electric stun device and the electrical conductivity between the electrically insulated darts (6) embedded in the living tissue. The electrical conductivity between the electrically insulated darts (6) embedded in living tissue due to the water and salt content of the living tissue as well as other chemicals in the tissue that conduct electricity is of primary importance. Electrical current will take the path of least resistance which would be the living tissue since the electrical insulating material of the electrically insulated covering (11) provides an electrical insulating barrier between the electrically insulated dart (6) and the protective garment. Therefore, several types of electrically insulating materials are suitable to be used as the electrically insulated covering (6).

In the preferred embodiment of the present invention, the most common suitable insulating material is magnet wire enamel insulation. Enamel insulation applies evenly, is hard after curing and has a smooth slick finish. These traits would not hinder the electrically insulated dart (6) from being expelled from the cartridge of the electric stun device but would aid in the ejection. Enamel insulation is comprised of the following three main types: THEIC Polyester/polyesterimide, Polyurethane and Polyamideimide. In the manufacture of magnet wire, enamel insulation is applied as coatings by drawing a single filament of wire through a vessel of liquid coating and then cured. The vessel can be a bath or a die. In the preferred embodiment of the present invention, the enamel coating is applied to the dart (1) of FIG. 1A by brush, dipping or spraying at least one or more coats to form the electrically insulated covering (11) of FIG. 2A and producing the electrically insulated dart (6) if FIG. 2A. The enamel coating or coatings are applied only after a good electrical and mechanical connection between all parts of the electrically insulated dart (7), including the tether (10), are established. The electrically insulated covering is then appropriately cured by processes well known to those skilled in the art.

In another embodiment of the present invention, epoxy insulating coating powders are another type of suitable coatings that come in a variety of grades that are used low to high voltage applications such as bus bars, capacitors, electric motor armatures, electric motor cores, electric motor stators, magnet wire, resistors, thermistors, toroid cores, varistors, etc. These powders are applied to these components by several methods including: Standard fluid bed, Electrostatic fluid bed, Cascade coating, Epoxy spray and Inline wheel coating.

In yet another embodiment of the present invention, another suitable coating type is ceramics which are proven protection for components used in the induction heating, welding and forging industries such as skid rails and rollers. Ceramic coatings are usually molten when applied to a component using one of a variety of thermal spray processes: wire arc spray, combustion spray, plasma spray and HVOF spraying.

In still another embodiment of the present invention, polymer coatings are generally elastomeric or thermoplastic which are applied in a liquid or powder form by air spray, airless spray, electrostatic spray, plural spray or dipping technology.

All of the processes mentioned for the application of an electrically insulating coating to individual components are processes that are well known to those skilled in the art and are applicable to all embodiments of present invention.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

I claim:

1. An electrically insulated covering wherein said electrically insulated covering is applied to each electric stun device dart of electric stun devices yielding an electrically insulated dart whereby said electrically insulated darts cannot be electrically short circuited to each other when penetrating electrically conductive protective garments.

2. The electrically insulated covering of claim 1 wherein said electric stun device dart is comprised of a barb, a shaft and a body whereby said electrically insulated covering is applied to said electric stun device dart with the exception of said barb.

3. The electrically insulated covering of claim 1 wherein said electric stun device dart is comprised of a barb, a shaft and a body whereby said electrically insulated covering is applied to said electric stun device dart with the exception of said barb and a portion of said shaft connected to said barb.

4. The electrically insulated covering of claim 1 wherein said electrically insulated covering is a magnet wire enamel insulation selected from the group comprising THEIC polyester/polyesterimide, polyurethane and polyamideimide.

5. The electrically insulated covering of claim 1 wherein said electrically insulated covering is an epoxy insulating coating powder.

6. The electrically insulating covering of claim 1 wherein said electrically insulated covering is a ceramic coating.

7. The electrically insulating covering of claim 1 wherein said electrically insulated covering is a polymer coating.

8. Electrically insulated darts for electric stun devices wherein an electrically insulated covering is applied to a electric stun device dart yielding an electrically insulated dart whereby said electrically insulated darts cannot be electrically short circuited to each other when penetrating electrically conductive protective garments manufactured using metal bearing materials.

9. The electrically insulated darts of claim 8 wherein said electric stun device dart is comprised of a barb, a shaft and a body whereby said electrically insulated covering is applied to said electric stun device dart with the exception of said barb.

10. The electrically insulated darts of claim 8 wherein said electric stun device dart is comprised of a barb, a shaft and a body whereby said electrically insulated covering is applied to said electric stun device dart with the exception of said barb and a portion of said shaft connected to said barb.

11. The electrically insulated darts of claim 8 wherein said electrically insulated covering is a magnet wire enamel insulation selected from the group comprising THEIC polyester/polyesterimide, polyurethane and polyamideimide.

12. The electrically insulated darts of claim 8 wherein said electrically insulated covering is an epoxy insulating powder coating.

13. The electrically insulated darts of claim 8 wherein said electrically insulated covering is a ceramic coating.

14. The electrically insulated dart of claim 8 wherein said electrically insulated covering is a polymer coating of elastomeric or thermoplastic.

* * * * *